United States Patent [19]

Crayne

[11] 4,136,908

[45] Jan. 30, 1979

[54] MOUNT FOR BARBER CHAIR ACCESSORY

[76] Inventor: Robert P. Crayne, 108 Newton Dr., Burlingame, Calif. 94010

[21] Appl. No.: 730,842

[22] Filed: Oct. 8, 1976

[51] Int. Cl.[2] ..... A47C 7/62

[52] U.S. Cl. ..... 297/188

[58] Field of Search ..... 297/188, 173; 108/95, 108/101, 106, 111, 144, 151–152, 149; 211/131, 163; 248/415, 425, 413, 124, 125

[56] References Cited

U.S. PATENT DOCUMENTS

| | | | |
|---|---|---|---|
| 518,733 | 4/1894 | Cook | 248/285 |
| 549,927 | 11/1895 | Meads | 248/285 X |
| 1,203,818 | 11/1916 | Trinkl | 108/95 |
| 1,588,914 | 6/1926 | Smith | 108/152 X |
| 1,795,296 | 3/1931 | De Zing | 248/285 |
| 2,375,696 | 5/1945 | Shick | 298/188 X |
| 2,954,955 | 10/1960 | Feller | 297/188 X |
| 2,970,701 | 2/1961 | Fetter | 108/151 X |
| 3,091,343 | 5/1963 | Neumann | 248/124 X |
| 3,101,849 | 8/1963 | Osborn | 211/131 X |
| 3,601,443 | 8/1971 | Jones | 297/188 |

*Primary Examiner*—James T. McCall
*Attorney, Agent, or Firm*—Phillips, Moore, Weissenberger, Lempio & Majestic

[57] ABSTRACT

A means for mounting accessories, such as a tray, lights or hair driers, for example, on the piston portion of conventional barber chairs is disclosed whereby the relative vertical positioning of the chair and accessory remains constant but the accessory may be rotated about the chair in a horizontal plane for ease of access or positioning.

10 Claims, 4 Drawing Figures

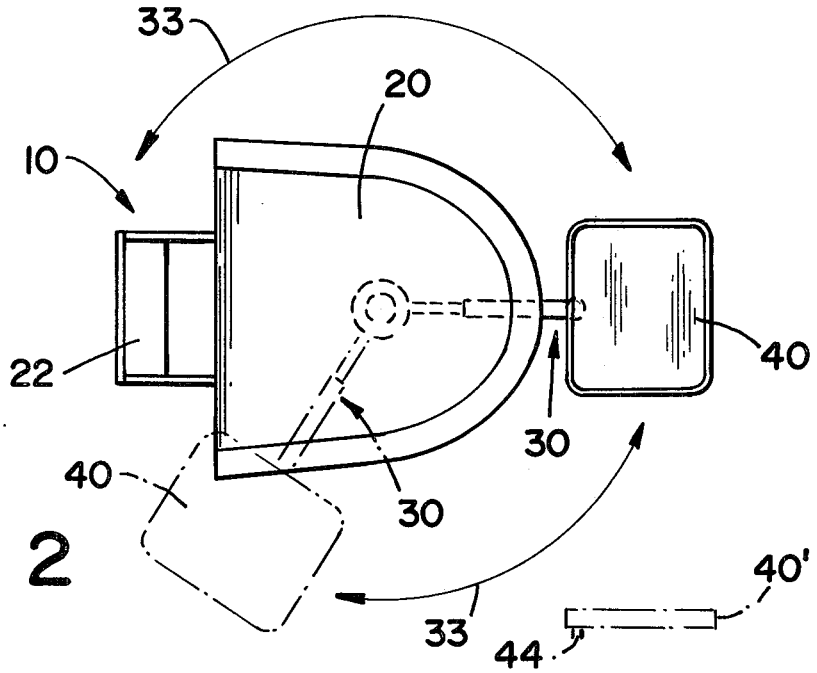
FIG _ 2
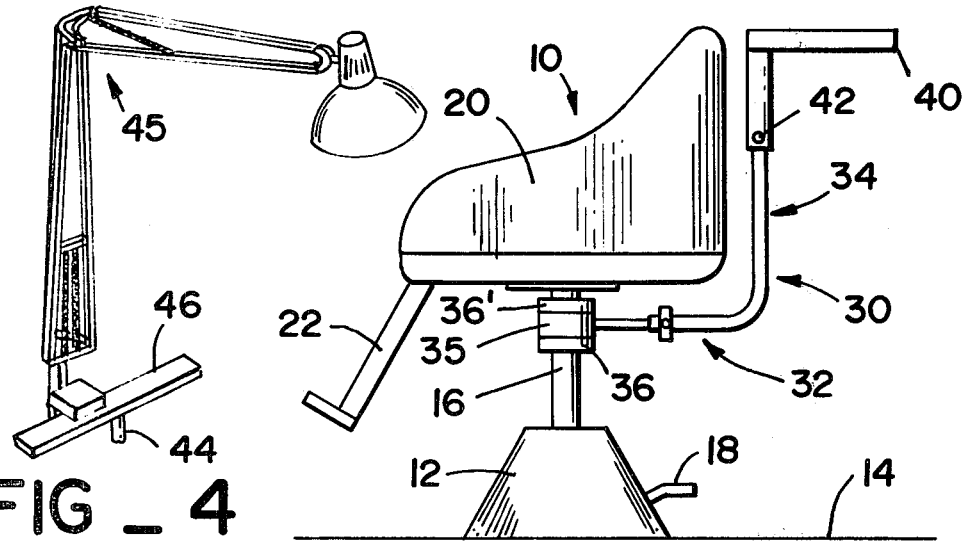
FIG _ 4
FIG _ 1
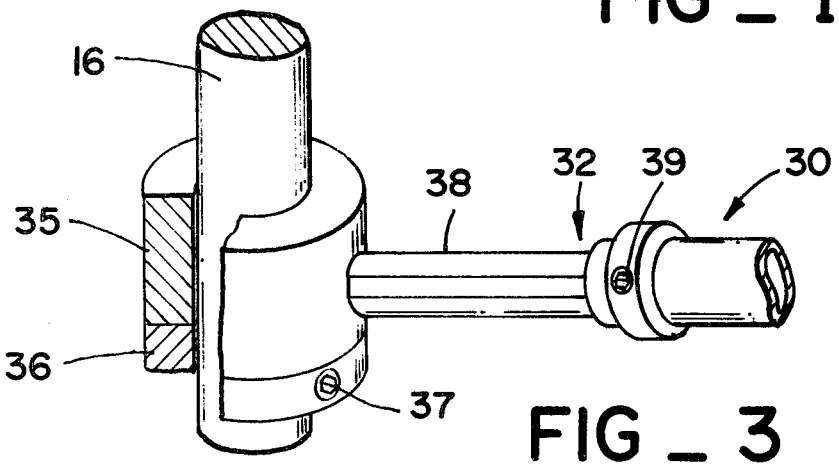
FIG _ 3

MOUNT FOR BARBER CHAIR ACCESSORY

BACKGROUND OF THE INVENTION

This invention relates to a means for mounting accessories such as trays, lights, hair driers or the like on hydraulic chairs of the type used by barbers and beauticians and more particularly to a means for mounting such accessories in a selected vertical position with respect to such chairs which remains constant while allowing the accessory to be freely rotated about the chair in a horizontal plane for ease of access or positioning.

Various accessories used by barbers and beauticians are now mounted on wheeled devices which roll along the floor to allow the accessory to be moved to a desired position adjacent a chair. However, such devices require floor space, even when not in use, and where several chairs are located in close proximity, interference between devices supporting accessories at adjacent chairs often occurs.

It is an object of this invention to provide a means for mounting accessories at a hydraulic chair of the type used by beauticians and barbers which does not require any additional floor space whether or not in use.

It has been proposed in the prior art to provide accessory mounting means attached to the pedestal of hydraulic chairs of the type used by barbers and beauticians. However such devices have been mechanically complicated and have required the use of wheels or bearing surfaces in positions where they are exposed to loose hair cut by the barber or beautician. Such loose hairs will tend to become entangled in the wheels or bearings and will be difficult to remove, eventually interfering with free movement.

It is another object of this invention to provide a means for mounting accessories at a hydraulic chair of the type used by beauticians and barbers which is mechanically simple, does not include wheels and the bearing surfaces of which are protected from loose hair.

Since the means according to the prior art for supporting accessories at a hydraulic chair of the type used by beauticians and barbers have either engaged the floor adjacent the chair or the pedestal of the chair and since the vertical height of the hydraulic chair is changed frequently in use, the relative vertical height of the chair and accessory is not constant. Thus, the accessibility and positioning of the accessory is changed in use and it is often necessary to adjust the vertical height of the accessory.

It is a further object of this invention to provide mechanically simple and easy to use means for mounting accessories at a hydraulic chair of the type used by barbers and beauticians which enables a selected relative vertical relationship between the accessory and the chair to be maintained regardless of changes in the vertical position of the chair while also enabling the accessory to be freely moved to selected relative positions with respect to the chair in a horizontal plane.

SUMMARY OF THE INVENTION

Briefly, this invention provides means for mounting accessories on a hydraulic chair structure of the type used by barbers and beauticians including a pedestal engaging the floor, a piston having one end received in the pedestal for relative vertical hydraulic movement with respect to the pedestal and a chair mounted on the other end of the piston. Such means comprises a rigid mounting ring coaxially surrounding the piston of the chair having end surfaces lying in parallel planes normal to the axis thereof. A rigid support ring coaxially surrounds the piston beneath the mounting ring and supports the mounting ring. The supporting ring has end surfaces lying in parallel planes normal to the axis thereof and the upper end surface of the support ring slidably abuts the lower end surface of the mounting ring. Means are provided for rigidly fixing the supporting ring to the piston and an elongated support arm is rigidly fixed at one end to the mounting ring. The support arm includes a first portion extending from the mounting ring normal to the axis thereof and a second portion extending upwardly from the first portion substantially parallel to the axis of the mounting ring terminating in a free end. Means are provided at the free end of the support arm for mounting an accessory thereon.

BRIEF DESCRIPTION OF THE DRAWING

The foregoing and other objects and features of this invention will be more fully understood from a reading of the following detailed description of preferred embodiments in conjunction with the drawing wherein:

FIG. 1 is a side view in elevation of a barber chair including a mount according to one embodiment of this invention supporting a tray in juxtaposition to the chair with an alternate form of the tray shown in dotted lines.

FIG. 2 is a top plan view of the barber chair mount and tray shown in FIG. 1 with an alternate position of the mount and tray shown in dotted lines and with arrows indicating the movement of the mount and tray made possible according to the teaching of this invention.

FIG. 3 is an enlarged fragmentary perspective view partially in cross-section showing a preferred embodiment of the barber chair accessory mount in accordance with the teaching of this invention.

FIG. 4 is a perspective view of a further one of the accessories which may be mounted on a barber chair according to the teaching of this invention.

DETAILED DESCRIPTION OF PREFERRED EMBODIMENTS

Referring to FIG. 1, a somewhat simplified view of a modern barber chair 10 of the type used by barbers and beauticians is shown in side elevation. Such a chair includes a pedestal 12 in engagement with the floor 14 and providing over-all support for the chair 10.

The pedestal 12 conventionally includes a hydraulic cylinder (not shown) which receives a vertically extending rod or piston 16 which is hydraulically actuated to move axially in a vertical direction by means of the cylinder in the pedestal 12. The movement of the piston 16 is conventionally controlled by a foot pedal 18 in the pedestal which may either actuate a hydraulic pump or control a hydraulic valve between the cylinder and an appropriate source of pressurized hydraulic fluid.

The seat portion 20 of the barber chair 10 is mounted on the free end of the piston 16 so that it may be raised or lowered by means of the piston 16 under the control of the foot pedal 18 to position a person seated therein for the convenience of the barber or beautician. The seat portion 20 of the chair 10 is conventionally provided with a foot rest 22 for the comfort of a person seated therein.

Applicant has found that barber chairs 10 are conventionally designed to provide lowermost vertical positions which are rarely, if ever, used by barbers and beauticians. Thus, an upper portion of the piston 16 at the free end thereof and directly under the seat portion 20 of the chair 10 always projects above the pedestal 12 in actual use. According to applicant's invention, an elongated support arm 30 is rotatably mounted on such upper portion of the piston 16 immediately under the seat portion 20 of the chair 10 which elongated support arm has a first portion 32 extending normally to the axis of the piston 16 and a second portion 34 extending upwardly from the first portion substantially parallel to the axis of the piston 16 to a free end. An accessory such as a tray 40 may be mounted on the free end of the elongated support arm 30.

Thus, as indicated by the double-headed arrows 33 in FIG. 2, the tray 40 may be moved about the axis of the piston 16 in a given horizontal plane. The elongated support arm 30 is designed so that the horizontal plane of rotation of the tray 40 will be conveniently positioned with respect to the seat portion 20 of the chair 10. The fact that the elongated support arm 30 and the tray 40 carried thereby are mounted on the piston 16 of the chair 10 will cause the horizontal plane of rotation of the tray 40 or other accessory mounted on the free end of the elongated support arm 30 to remain constant with respect to the seat portion 20 of the chair 10 regardless of vertical movement of the chair 10.

Referring to FIG. 3, an enlarged fragmentary view in perspective and partially in cross-section of the preferred embodiment of the mount in accordance with the teaching of this invention is shown. According to the preferred embodiment, a rigid mounting ring 35 coaxially surrounds the piston 16. The mounting ring 35 receives the piston 16 therewithin with a close tolerance and has end surfaces lying in parallel planes normal to the axis of the piston 16. The tolerance between the internal surface of the mounting ring and the external surface of the piston 16 is such that the mounting ring may be freely rotated about the piston 16.

The mounting ring 35 is supported along the axis of the piston 16 by means of a rigid support ring 36 coaxially surrounding the piston 16 beneath the mounting ring 35. The support ring 36 is rigidly fixed along the axis of the piston 16 by appropriate means such as one or more set screws 37 and the support ring 36 has an upper surface lying in a plane normal to the axis of the piston 16 and in slidable abutment with the lower end surface of the mounting ring 35.

As shown in FIG. 3, one end of the elongated support arm 30 is rigidly fixed to the mounting ring 35 and projects therefrom normal to the axis of the piston 16. As shown in FIG. 3, it is preferred that the portion 32 of the support arm 30 be made telescopic in order to accommodate variations in the dimensions of the seat portion 20 of conventional barber chairs now in use. Thus, a rigid rod 38 has one end rigidly fixed to the mounting ring 35 and extends to a free end spaced some distance from the mounting ring 35. The elongated support arm 30 may be tubular and adapted to telescope over the rod 38. An appropriate means such as set screw 39 may be provided through the wall of the tubular elongated support arm 30 to enable a desired telescoped position of the elongated support arm 30 and rod 38 to be rigidly fixed.

Applicant has found that it is possible with all barber chairs conventionally in use to either remove the seat portion 20 of the barber chair 10 from the free end of the piston 16 or to remove the piston 16 from the pedestal 12 in order to slip the mounting ring 35 and support ring 36 over the piston 16 and position them adjacent the free end thereof. Referring again to FIG. 1, a second support ring 36' identical to the support ring 36 may be positioned above the mounting ring 35 with a lower planar surface extending normal to the axis of the piston 16 in slidable abutment with the upper end surface of the mounting ring 35 in order to minimize contact between the inner surface of the mounting ring 35 and the exterior surface of the piston 16.

Applicant has also found that it is only necessary to make mounting rings 35 and support rings 36 in two sizes in order to fit substantially all barber chairs now in use. Most barber chairs have a piston that is about 1 inch (2.5 cm) in diameter. Thus, a mounting ring having an internal diameter of $1\frac{1}{8}$ inch (3 cm) and a length of $2\frac{3}{4}$ inch (7 cm) with a wall thickness of about $\frac{1}{4}$ inch (0.6 cm) is suitable for use with most barber chairs. Similarly, a support ring 36 having an internal diameter of about $1\frac{1}{8}$ inch (3 cm) and a length of $\frac{3}{8}$ inch (1.0 cm) with a wall thickness of $\frac{1}{4}$ inch (0.6 cm) having an appropriate set screw or set screws threaded therethrough is suitable for use with most barber chairs.

Almost all of the remaining barber chairs have a piston of about 3 inches (7.5 cm) in diameter and applicant has found that a mounting ring 35 having an internal diameter of about $3\frac{1}{4}$ inches (8.0 cm) a length of $2\frac{3}{4}$ inches (7.0 cm) and a wall thickness of $\frac{1}{4}$ inch (0.6 cm) will enable the mounting of accessories according to the teaching of this invention on almost all of the remaining barber chairs. Similarly, the support ring 36 used therewith should have an internal diameter of about $3\frac{1}{4}$ inches (8.0 cm) a length of $\frac{3}{8}$ inch (1.0 cm) and a wall thickness of $\frac{1}{4}$ inch (0.6 cm) with an appropriate set screw or set screws threaded therethrough.

The portion 32 of the elongated support arm 30 may be welded to the exterior side surface of the mounting ring 35. Preferably the mounting ring 35 is provided with an aperture to receive an end portion of the elongated support arm 30 prior to welding, brazing or otherwise rigidly fixing the end of the support arm 30 to the mounting ring 35.

Referring again to FIG. 1, it will be seen that the tray 40 or other accessory may be adapted to telescope over the free end of the portion 34 of the elongated support arm 30. An appropriate set screw 42 or other means may be provided in order to enable the horizontal plane of rotation of the tray 40 or other accessory to be adjusted in vertical position with respect to the seat portion 20 of the barber chair 10. Alternatively, as shown in dotted lines in FIG. 1, the tray 40' or other accessory may be provided with an appropriate plug or rod 44 dimensioned to be inserted within a tubular elongated support arm 30 in which case, a fixed relationship would be established between the tray 40' and the seat portion 20 of the chair 10.

Referring to FIG. 4, a variety of accessories may be mounted on the free end of the support arm 30. Thus, as shown in FIG. 4, an articulated heat lamp 45 may be adjustably clamped to a support bar 46. The support bar 46 may be provided with a plug or rod 44 adapted to be received within the free end of a tubular support arm 30, as mentioned hereinabove. Alternatively, the support bar 46 could be provided with an adjustable telescoping means as described hereinabove with respect to FIG. 1. It will be understood that hair driers, blowers and illuminating lamps could be carried on the support bar 46 or on the tray 40 and positioned as desired with respect to the head of a person seated in the barber chair 10 which position would not change upon adjustment in the vertical height of the chair 10. A tray 40 would, of course, enable various equipment and supplies to be conveniently positioned for ready access to the barber or beautician in use.

It will be noted from FIG. 2 that the foot rest 22 of the barber chair 10 will limit the rotation of the mounting means, according to this invention, about the barber chair 10. However, the barber or beautician seldom desires to work from a position adjacent the foot rest 22. Furthermore, where the seat portion of the barber chair 10 is tiltable with respect to the axis of the piston 16, it is desirable to move the mounting means to a position adjacent the foot rest 22 but not necessarily directly thereover in order to accommodate the tilting movement of the chair 10.

From the above it will be seen that a simple and effective means has been provided according to the teaching of this invention for the mounting of accessories with respect to a barber chair 10. The mounting means lies directly under the seat portion 20 of the chair 10 and above the floor 14. Thus hair cut from the head of a person seated in the chair 10 cannot become entangled in the mounting means and interfere with the free rotation thereof about the chair. In addition, the mounting means according to this invention, is adapted to move vertically with the chair 10 thus maintaining a desired vertical relationship between an accessory carried thereby and the chair 10 regardless of adjustments in the vertical height of the chair 10 above the floor 14.

It is believed that those skilled in the art will make obvious modifications in the embodiments of this invention shown in the drawing and specifically described above without departing from the scope of the following claims.

What is claimed is:

1. In a hydraulic chair structure of the type used by barbers and beauticians comprising a pedestal engaging the floor, a piston having one end received in said pedestal for relative vertical hydraulic movement with respect to said pedestal and a chair mounted on the other end of said piston, the improvement comprising:

a. a rigid mounting ring coaxially surrounding said piston with a close tolerance for rotation thereabout, said mounting ring having a lower end surface lying in a plane normal to the axis thereof;

b. a rigid support ring coaxially surrounding said piston and rigidly fixed thereto at said other end thereof beneath said mounting ring and supporting said mounting ring thereon immediately adjacent said chair, said support ring having an upper end surface lying in a plane normal to the axis thereof with said upper end surface of said support ring slidably abutting the lower end surface of said mounting ring;

c. means rigidly fixing said rigid support ring to said piston;

d. an elongated support arm having one end rigidly mounted on said mounting ring and a first portion extending from said one end of said support arm normal to the axis of said mounting ring; said support arm having a second portion extending upwardly from said first portion substantially parallel to the axis of said mounting ring to a free end; and e. means mounting an accessory on said free end of said support arm.

2. In a hydraulic chair structure as claimed in claim 1 wherein said mounting ring has an upper end surface lying in a plane parallel to the plane of said lower end surface thereof, and wherein a second rigid support ring coaxially surrounds said piston above said mounting ring, said second rigid support ring having a lower end surface lying in a plane normal to the axis thereof with said lower end surface of said support ring slidably abutting said upper end surface of said mounting ring.

3. In a hydraulic chair structure as claimed in claim 1 wherein said first portion of said elongated support arm is telescopic and includes means for rigidly maintaining a selected telescoped position.

4. In a hydraulic chair structure as claimed in claim 1 wherein said means mounting an accessory on said free end of said support is telescopic and includes means for rigidly maintaining a selected telescoped position.

5. In a hydraulic chair structure as claimed in claim 3 wherein said elongated support arm is tubular and said telescopic first portion thereof includes a rigid rod adapted to be received within said tubular elongated support arm, one end of said rigid rod being rigidly fixed to said mounting ring and said rigid rod projecting from the side surface of said mounting ring normal to the axis thereof.

6. In a hydraulic chair structure as claimed in claim 1 wherein said elongated support arm is tubular and said means mounting an accessory on said free end of said support arm comprises a body extending in a given plane with a rod adapted to be received within the free end of said tubular support arm extending normally to said given plane.

7. In a hydraulic chair structure as claimed in claim 1 wherein said rigid mounting ring has an axial length of about $2\frac{3}{4}$ inches.

8. In a hydraulic chair structure as claimed in claim 7 wherein said rigid support ring has an axial length of about $\frac{3}{8}$ inch.

9. In a hydraulic chair structure as claimed in claim 8 wherein said rigid mounting ring and said rigid support ring each have a wall thickness of about $\frac{1}{4}$ inch.

10. In a hydraulic chair structure as claimed in claim 9 wherein said piston has an external diameter of about 1 inch and said rigid mounting ring and said rigid support ring each have an internal diameter of about $1\frac{1}{8}$ inch.

* * * * *